US008087414B2

(12) United States Patent
Gutierrez Ugarte

(10) Patent No.: US 8,087,414 B2
(45) Date of Patent: Jan. 3, 2012

(54) MACHINE FOR STYLING HAIR IN THE FORM OF LONG LOCKS OF HAIR ENTWINED IN DREADLOCKS

(76) Inventor: Kelian Gutierrez Ugarte, Orduña (ES)

( * ) Notice: Subject to any disclaimer, the term of this patent is extended or adjusted under 35 U.S.C. 154(b) by 365 days.

(21) Appl. No.: 12/442,938

(22) PCT Filed: Jul. 31, 2007

(86) PCT No.: PCT/ES2007/000473

§ 371 (c)(1),
(2), (4) Date: Mar. 25, 2009

(87) PCT Pub. No.: WO2008/037823

PCT Pub. Date: Apr. 3, 2008

(65) Prior Publication Data

US 2010/0006117 A1 Jan. 14, 2010

(30) Foreign Application Priority Data

Sep. 28, 2006 (ES) ..... 200602478

(51) Int. Cl.
*A45D 7/02* (2006.01)
*D05B 1/00* (2006.01)
*D05B 69/00* (2006.01)

(52) U.S. Cl. ..... 132/212; 112/169; 112/221

(58) Field of Classification Search ..... 132/212, 132/201, 207, 210, 119.1, 226, 227, 122, 132/238, 239, 270, 271, 272, 245, 265, 53, 132/55, 56, 333, 151, 161, 237, 112, 114; 87/3; 112/139, 169, 221; 57/4, 28, 29; 119/609, 119/664; 242/472, 916; 606/222, 223, 144, 606/145, 147, 148, 167, 185, 186, 187, 188; 66/1 A See application file for complete search history.

(56) References Cited

U.S. PATENT DOCUMENTS

| | | | | | |
|---|---|---|---|---|---|
| 1,764,626 | A | * | 6/1930 | Heckman | 15/384 |
| 3,055,165 | A | * | 9/1962 | Richards | 57/29 |
| 3,071,917 | A | * | 1/1963 | Fisher | 425/391 |
| 4,427,017 | A | * | 1/1984 | Eronini | 132/271 |
| 4,509,538 | A | * | 4/1985 | Ramik | 132/212 |
| 4,580,585 | A | * | 4/1986 | Sapkus | 132/212 |
| 4,582,074 | A | * | 4/1986 | Schwager et al. | 132/212 |
| 4,583,561 | A | * | 4/1986 | Larsson | 132/212 |
| 4,824,036 | A | * | 4/1989 | Buta | 242/442 |
| 5,119,847 | A | * | 6/1992 | Powell et al. | 132/226 |
| 5,456,271 | A | * | 10/1995 | Legette | 132/212 |

(Continued)

FOREIGN PATENT DOCUMENTS

BE 1001342 A3 10/1989

(Continued)

*Primary Examiner* — Rachel Steitz
*Assistant Examiner* — Vanitha Elgart
(74) *Attorney, Agent, or Firm* — Egbert Law Offices PLLC

(57) ABSTRACT

Machine for styling hair in the form of long locks of hair entwined in dreadlocks includes a container body accommodating an electric or pneumatic motor. There is a handle which, in its lower front part, forms a nose through which an interchangeable harpoon needle projects, the needle being provided with at least one traction harpoon and being installed in a particular rotary position with the aid of removable device. The container body has a switch above and behind the nose. The electric or pneumatic motor has a regulator for the speed and has a shaft, which extends parallel to the interchangeable harpoon needle, rotationally coupled to it.

2 Claims, 1 Drawing Sheet

U.S. PATENT DOCUMENTS

| | | | | |
|---|---|---|---|---|
| 5,488,963 | A * | 2/1996 | Fishman | 132/212 |
| 5,603,339 | A | 2/1997 | Brazeal et al. | |
| 5,725,000 | A * | 3/1998 | Rice | 132/210 |
| 5,967,150 | A | 10/1999 | Wright et al. | |
| 6,109,275 | A * | 8/2000 | Mendezmonsanto | 132/212 |
| 6,314,966 | B1 * | 11/2001 | Yokokawa | 132/148 |
| 6,318,378 | B1 * | 11/2001 | Kennedy et al. | 132/212 |
| 6,499,491 | B2 * | 12/2002 | Kennedy et al. | 132/212 |
| 6,520,187 | B1 * | 2/2003 | Lee et al. | 132/212 |
| 6,782,896 | B1 * | 8/2004 | Grimes | 132/212 |
| 6,827,089 | B2 * | 12/2004 | Lee et al. | 132/212 |
| 6,962,159 | B1 * | 11/2005 | Adam | 132/210 |
| 7,124,918 | B2 * | 10/2006 | Rascoe | 223/48 |
| 7,232,446 | B1 * | 6/2007 | Farris | 606/144 |
| 7,284,557 | B1 * | 10/2007 | Williams | 132/212 |
| 2001/0052347 | A1 * | 12/2001 | Kennedy et al. | 132/212 |
| 2002/0189629 | A1 * | 12/2002 | McGriff, III | 132/227 |
| 2003/0131867 | A2 * | 7/2003 | Kennedy et al. | 132/200 |
| 2003/0188760 | A1 * | 10/2003 | Ogunro et al. | 132/212 |
| 2003/0230316 | A1 * | 12/2003 | Glucksman et al. | 132/212 |
| 2004/0216758 | A1 | 11/2004 | Rascoe et al. | |
| 2004/0237991 | A1 * | 12/2004 | Glucksman et al. | 132/271 |
| 2009/0071492 | A1 * | 3/2009 | Oh | 132/201 |
| 2010/0036317 | A1 * | 2/2010 | Oginski et al. | 604/131 |

FOREIGN PATENT DOCUMENTS

| | | | |
|---|---|---|---|
| DE | 3844042 | A1 | 6/1990 |
| ES | 1056895 | U | 5/2004 |
| WO | WO 0122845 | A1 | 4/2001 |

* cited by examiner

MACHINE FOR STYLING HAIR IN THE FORM OF LONG LOCKS OF HAIR ENTWINED IN DREADLOCKS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

This invention relates to a machine for styling hair in the form of long locks of hair entwined in, which, by lexicological extension, are known in the language of the street by the name "dreadlocks". This hair style is also termed "rasta" due to being the form of styling typical of the followers of the "Rastafari" religion, who are people who style their hair in this way.

2. Description of Related Art Including Information Disclosed Under 37 CFR 1.97 and 37 CFR 1.98

A dreadlock is a type of tube of hair in which the hairs are entwined, being woven together, so that there are no loose hairs, and its structure is kept stable over time. Originally, this hairstyle was peculiar to African ethnic groups which naturally have hair in small curls, in which entangling of the hairs occurs very easily. These days, for fashion reasons, this hair style is requested by people with hair of all kinds, including straight hair, in which it is much more difficult to obtain dreadlocks.

There are various different techniques for making a dreadlock.

The technique advised most is the natural one, in which no chemical product whatsoever is used. A variant of the natural technique is that of teaselling, in which teaselling is carried out lock by lock and the locks are then rounded with the hands. With this technique, the dreadlock does not turn out tight and can be undone. In fact, several months are needed for the dreadlocks to be well compacted and formed, months during which they must be well cared for. This technique is not suitable for being applied to straight hair.

Although coarse and rudimentary, another way of obtaining dreadlocks is stopping combing one's hair, which proves to take an excessive amount of time (it may take years, depending on each person's hair type) and, with this technique, it is not possible to control the diameter of the dreadlocks, each of which will turn out to be of a different size. Another variant, the one preferred, is called the crochet type and consists of the interweaving being carried out in a totally manual way, with the aid of an interchangeable harpoon needle of the type for crocheting, with which the lock of hair is penetrated and, with a to and fro movement, hair is introduced towards the center of the lock. In this way, a type of sewing is carried out between the hairs and compact, well defined dreadlocks are obtained from the start. Although, it is very laborious, takes a long time, is very expensive and proves to be very arduous for the person subjected to it, as it also is for the hairdresser, who ends up suffering from occupational exhaustion and is exposed to postural health problems. Once hair has been done like this, it does not cake. It is left with natural movement and does not require as much care as is given with other techniques which are referred to above. Other known techniques are based on the use of chemical products intended for simplifying and speeding up the making of dreadlocks. These techniques are contra-indicated for healthy hair, as chemical products seriously damage the internal and external capillary structure, possibly producing diseases of the dermis in the scalp (allergies, alopecia and seborrhoeic dermatitis, among others). Apart from the negative repercussions on the customer's health, which is the most important thing, it also affects the image and professional standing of the hairdressers and, for this reason, many of these professionals refuse to apply these techniques.

Patent US 2004/0028632 is known, being based on the use of a chemical product intended to cause hair to thicken, for the purpose of helping the subsequent entwining thereof. With this technique, no sewing between hairs is achieved, and the dreadlock comes undone when it is washed. The use of chemical products usually takes place at specialized hairdressers' salons for reducing the time of the process. On the other hand, bearing in mind the variety of hair types, arranging for them to be well formed and defined, they resort to giving permanent waves (sometimes two or three perms in succession), whereupon the hair suffers considerable detriment for the hair and dries out appreciably. This way of making dreadlocks is very expensive for the customer and, when he wishes to change hair styles, there is no alternative but to have his hair cut and let it grow again, as it has become damaged so much that the situation is unrecoverable for undoing the dreadlocks and producing another type of hair style.

It is understood from that which is set out above that the ideal would be to have some machine, capable of mechanizing the to and fro movement characteristic of the technique referred to above as the crochet technique but no such thing exists.

Micro-pigmentation machines for tattooing skin, such as the one in U.S. Pat. No. 4,644,952, are known. However, this type of machine is of no use for the aims sought as, for one thing, the travel necessary for pigmenting skin is much shorter (of the order of 3 mm) than the travel which is needed for interweaving dreadlocks (between 8 and 11 mm). For another thing, the force needed for tattooing skin is very low, whereas a considerable force of traction is needed for forming dreadlocks.

BRIEF SUMMARY OF THE INVENTION

In view of this situation, this invention advocates a machine which comprises a container body, which accommodates within it an electric or pneumatic motor and which is of an ergonomic design in the form of a handle which, in its lower front part, forms a nose through which an interchangeable harpoon needle projects. The needle is provided with at least one traction harpoon and, with the aid of removable means, is installed in a particular rotary position. This body has a switch above and behind the said nose. The electric or pneumatic motor has means for regulating the speed and has a shaft, which extends parallel to the interchangeable harpoon needle, rotationally coupled to it and from the periphery of which a fin of endless undulating section projects, through each of two longitudinal halves of this shaft. The undulating section forms a half sinusoid, the fin of which is laterally caught between the external rotary rings of their respective bearings which are fitted on pivots which are radial with respect to the electric or pneumatic motor shaft and transverse with respect to a shuttle which has means of longitudinal guidance and in which the interchangeable harpoon needle is fitted. In accordance with an optional embodiment, there is provision for the interchangeable harpoon needle to have two or more traction harpoons.

In this advocated composition, the turning of the rotary shaft, which is driven by the electric or pneumatic motor, produces, by means of its peripheral fin, a to and fro movement which is transmitted directly to the shuttle in which the interchangeable harpoon needle is fitted. With this device, the appreciable force is produced which is necessary for the work of weaving dreadlocks. In addition, by simply altering the amplitude of the peripheral fin section sinusoid, it is possible to alter the working stroke of the shuttle and, therefore, of the interchangeable harpoon needle.

With this machine, it is possible to apply the natural crochet technique for making dreadlocks with a great time saving which makes the work less arduous for the hairdressing professional and less tedious for the user. For one thing, this means that the cost of the hair style for the customer is significantly reduced and, for another thing, it works in favor of avoiding resorting to the use of chemical products tending to simplify and speed up the making of dreadlocks. Thus, it is possible to avoid the damage done to hair, which has been set out above (allergies, alopecia, seborrhoeic dermatitis, drying out, breaks, etc.).

Another outstanding benefit of the invention consists of making a means, available to the professional hairdressing sector, with which it would be possible to make dreadlocks in a much faster and more comfortable way and with high quality in the end result. It will encourage many hairdressers to use it, if hairdressers had until now rejected it or if hairdressers resorted to using harmful chemical products to make dreadlocks. It is also to be emphasized that, with the machine recommended, it is possible to make and undo dreadlocks as many times as is desired, something which has not happened until now.

This system supports the creativity of the professional, by means of which he can use dreadlocks as a method of preparation before cutting or carrying out some other customary process in hairdressing, thus working to create jobs with their own identities.

Another feature of this machine of the invention is its marketing capacity, which can be complemented with multimedia products explaining its method of use, as well as its possibilities for artistic expression.

BRIEF DESCRIPTION OF THE SEVERAL VIEWS OF THE DRAWINGS

In order for the nature of the invention to be understood better, an industrial embodiment is shown in the attached drawings, the embodiment having the nature of an example which is merely illustrative and not limiting.

Figure 1:
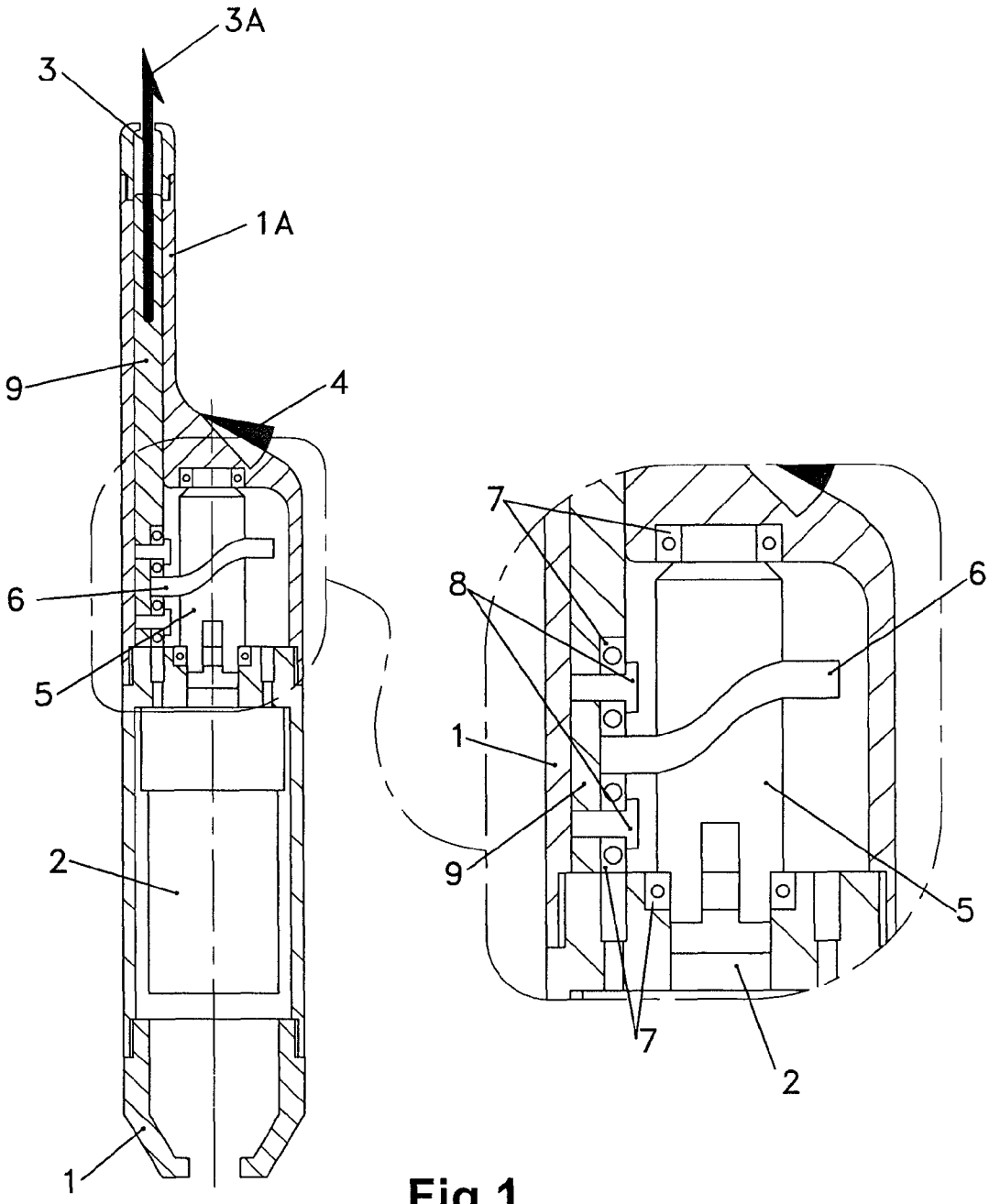
FIG. 1 is a view which shows, in longitudinal section, a machine according to the invention. This FIG. 1 includes an enlargement of a detail relating to the rotary shaft (5) and the fitting of its peripheral fin (6).

The following references are shown in this illustration:

1. Container body
1*a*. Nose of the container body (1)
2. Electric or pneumatic motor
3. Interchangeable harpoon needle
3*a*. Traction harpoon of the interchangeable harpoon needle (3)
4. Switch
5. Rotary shaft
6. Peripheral fin of the rotary shaft (5)
7. Bearings
8. Pivots
9. Shuttle

DETAILED DESCRIPTION OF THE INVENTION

In connection with the drawings and references listed above, in the attached drawings a preferred embodiment of the object of the invention is illustrated, relating to a machine for styling hair in the form of long locks of entwined hair. The machine, as FIG. 1 illustrates, comprises a container body (1) which accommodates within it an electric or pneumatic motor (2) and which is of an ergonomic design in the form of a handle which, in its lower front part, forms a nose (1*a*) through which an interchangeable harpoon needle (3) projects, said needle being provided with at least one traction harpoon (3*a*) and, with the aid of removable means, being installed in a particular rotary position. This body (1) has a switch (4) above and behind the nose (1*a*). The electric or pneumatic motor (2) has means for regulating the speed and has a shaft (5), which extends parallel to the interchangeable harpoon needle (3), rotationally coupled to it and from the periphery of which a fin (6) of endless undulating section projects, through each of two longitudinal halves of this shaft (5), the undulating section forming a half sinusoid, the fin (6) of which is laterally caught between the external rotary rings of their respective bearings (7) which are fitted on pivots (8) which are radial with respect to the shaft (5) of the electric or pneumatic motor (2) and transverse with respect to a shuttle (9) which has means of longitudinal guidance and in which the interchangeable harpoon needle (3) is fitted.

The interchangeable harpoon needle (3) is fitted in a specific angular position and is easily removable in order to be exchanged for any of the usual mechanical arrangements of removable elements.

A possible preferred embodiment consists of the interchangeable harpoon needle (3) having two or more traction harpoons (3*a*).

From the functional point of view, the machine of the invention is used as follows: with the electric or pneumatic motor (2) stopped, the interchangeable harpoon needle (3) is passed through the lock of hair of the person wishing to have a dreadlock made. The switch (4) is then pressed, and the shaft (5) is driven rotationally, which shaft (5), by means of the action of the fin (6) via the bearings (7), causes the to and fro movement of the shuttle (9) which, by means of the interchangeable harpoon needle (3) with traction harpoon (or traction harpoons) (3*a*), carries out the interweaving of the hairs in the lock of hair, which are introduced at high speed towards the centre of the lock itself.

I claim:

1. A machine for styling long locks of hair entwined in dreadlocks, the machine comprising:

a body having an interior;

a motor positioned in said interior of said body, said motor being electric or pneumatic, said body having a handle extending outwardly therefrom, said handle defining a nose having an interior passageway;

a harpoon-shaped needle extending through said interior passage so as to have a barbed end projecting outwardly of said handle, said barbed end positioned at an end of said harpoon-shaped needle;

a switch affixed to said body behind said nose, said switch being connected to said motor, said motor having a means for regulating a speed thereof, said motor having a shaft extending in parallel relation to said harpoon-shaped needle and rotationally coupled thereto;

an undulating fin projecting radially from said shaft, said shaft having a pair of longitudinal halves, said undulating fin extending through said pair of longitudinal halves, said undulating fin having an undulation forming a half sinusoid, said undulating fin being caught between external rotary rings of respective bearings which are fitted on pivots, said pivots being radial relative to said shaft; and a shuttle receiving said harpoon-shaped needle such that said harpoon-shaped needle is interchangeably connected thereto, said pivots being transverse relative to said shuttle, said shuttle being longitudinally guidable.

2. The machine of claim 1, said harpoon-shaped needle being fitted in a specific angular articulation.

* * * * *